US006438902B1

(12) United States Patent
Muller

(10) Patent No.: US 6,438,902 B1
(45) Date of Patent: Aug. 27, 2002

(54) FREE-STANDING SMALL CABIN

(76) Inventor: Harald Georg Muller, Hinterlandeswaldstrasse 2, Schlangenbad D-65388 (DE)

( * ) Notice: Subject to any disclaimer, the term of this patent is extended or adjusted under 35 U.S.C. 154(b) by 0 days.

(21) Appl. No.: 09/380,120

(22) PCT Filed: Feb. 18, 1998

(86) PCT No.: PCT/DE98/00497

§ 371 (c)(1), (2), (4) Date: Nov. 12, 1999

(87) PCT Pub. No.: WO98/38403

PCT Pub. Date: Sep. 3, 1998

(30) Foreign Application Priority Data

Feb. 26, 1997 (DE) ..... 197 07 625

(51) Int. Cl.[7] ..... A47K 11/00

(52) U.S. Cl. ..... 52/79.1; 52/34; 52/36.2; 52/79.9; 4/460; 4/479

(58) Field of Search ..... 52/34, 35, 36.2, 52/79.1, 79.9, 79.5, 284, 282.3, 282.4; 4/460, 461, 463, 479, 483; 312/257.1, 263, 265.1, 265.4; 211/4.28, 4.31, 4.33, 4.34; D25/16

(56) References Cited

U.S. PATENT DOCUMENTS

| | | | | |
|---|---|---|---|---|
| 1,753,487 A | | 4/1930 | Vaaler | |
| 4,305,164 A | * | 12/1981 | Sargent et al. | 4/462 |
| 4,378,137 A | | 3/1983 | Gibson et al. | |
| 4,744,111 A | * | 5/1988 | Tegg et al. | 4/460 |
| 4,831,671 A | * | 5/1989 | Harding | 4/460 |
| 5,310,073 A | * | 5/1994 | Johannsson | 220/254 |
| 5,359,828 A | | 11/1994 | Day | |
| 5,413,236 A | * | 5/1995 | Kenevan | 220/4.28 |
| 5,500,962 A | * | 3/1996 | Tagg | 52/79.1 X |
| 5,560,508 A | * | 10/1996 | Hsu | 220/4.31 |
| 5,682,622 A | * | 11/1997 | Tagg | 52/79.1 X |
| 5,704,699 A | * | 1/1998 | Pagelow et al. | 312/265.3 |
| 5,706,613 A | * | 1/1998 | Drake, Jr. et al. | 52/79.1 |
| 5,749,178 A | * | 5/1998 | Garmong | 52/79.1 |

FOREIGN PATENT DOCUMENTS

| | | | |
|---|---|---|---|
| DE | 2851786 | | 12/1980 |
| DE | 87 15 743.8 | | 3/1988 |
| DE | 3704377 | | 8/1988 |
| DE | 4101322 | | 7/1992 |
| DE | 9113262 | * | 4/1993 |
| FR | 2685726 | | 7/1993 |
| FR | 2690473 | | 10/1993 |
| GB | 2 271 581 | | 4/1994 |

* cited by examiner

*Primary Examiner*—Winnie S. Yip
(74) *Attorney, Agent, or Firm*—Killworth, Gottman, Hagan & Schaeff LLP

(57) ABSTRACT

The present invention relates to an easily erected small cabin, in particular a toilet cabin, which is provided with a floor part (1), a ceiling part (2), a wall element (3) and corner posts (4) connecting together the wall elements, floor part and ceiling part, and wherein all the parts described hereinabove are manufactured from plastics. In order to provide an easily erected cabin of the type described in the introduction, which is manufactured almost completely from plastics, and nevertheless has strong mechanical cohesion, it is proposed according to the invention that either on the posts on the one hand and the floor part and ceiling part on the other hand, and/or on the wall elements on the one hand and floor and ceiling part on the other hand, and/or on the wall elements on the one hand and the posts on the other hand, alternately overlapping connecting elements (5, 6, 7) are provided which have bores (11, 15) which, when the relevant parts are assembled, line up with one another, and through which locking bolts (9) extend which ensure the cohesion of the parts connected together.

21 Claims, 6 Drawing Sheets

Figure 1:
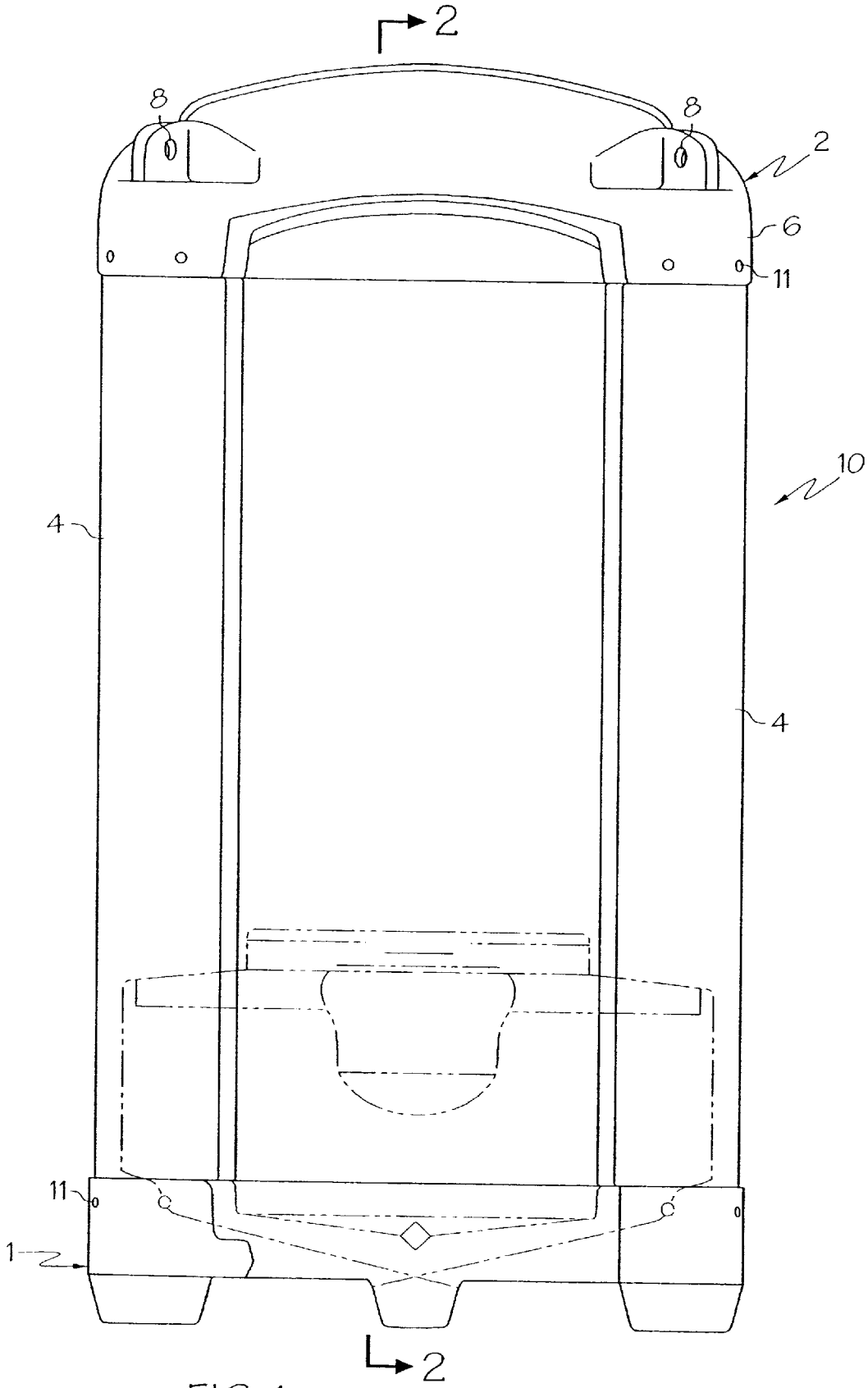

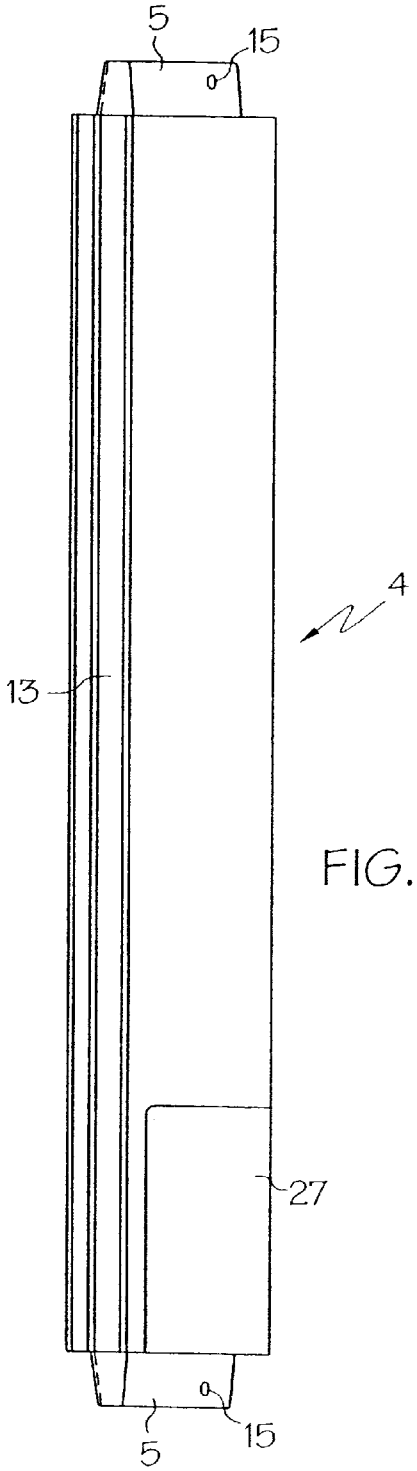
FIG. 5
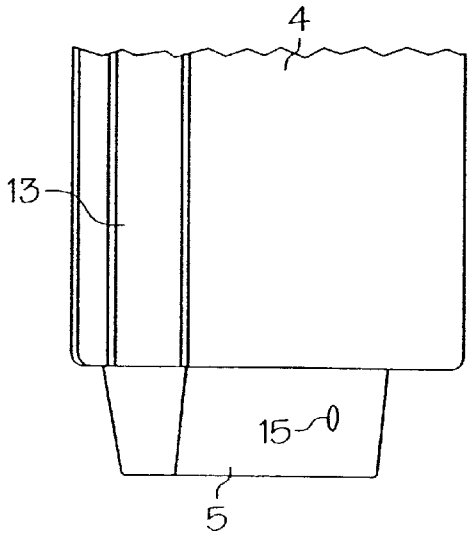
FIG. 6
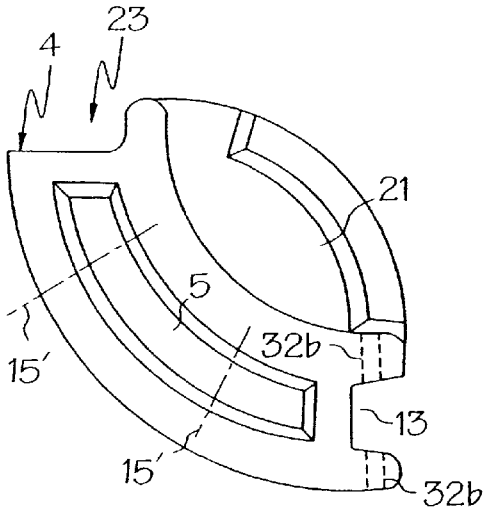
FIG. 7
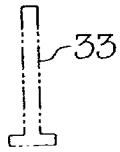

FREE-STANDING SMALL CABIN

The present invention relates to an easily erected small cabin, in particular a toilet cabin, which is provided with a floor part, a ceiling part, wall elements and corner posts holding and connecting together the wall elements, wherein all the parts identified above are manufactured from plastics.

Within the meaning of the present invention, a "small" cabin is understood to be a cabin which encloses a maximum of a few cubic metres such that it is, for example, still relatively easily transportable, and can be lifted and transported by means of a fork-lifter or small crane mounted on a truck. In particular, the small cabin should be transportable as a unit, which, in particular for the transportation of a large number of cabins, nevertheless does not exclude said cabins being dismantled into their individual parts and under certain conditions transported in a more space-saving manner in this way.

The individual parts of such a cabin are generally assembled in an interlocking manner, however, known cabins of the type described hereinabove have poor mechanical cohesion and a very low degree of torsional rigidity. Forces applied on one side or shearing forces can easily result in wall elements and posts or respectively the ceiling part and posts, or ceiling part and wall elements losing their interlocked connection and falling apart. Such forces can occur above all when such cabins are being erected or loaded.

Cabins are, moreover, also already known which have steel rods in the corner areas which produce a strong mechanical cohesion of the cabin. The manufacturing and assembly of such cabins is, however, relatively complex and expensive. Furthermore, with such cabins there is a considerable problem with the different expansion coefficient of steel and plastics, to the extent that cabins erected outdoors are often subjected to very great variations in temperature. This can very quickly lead to fatigue failures in the plastics material or to twisting and deformation of the entire cabin.

With respect to this prior art, the object of the present invention is to provide an easily erected cabin of the type described in the introduction, which is manufactured almost entirely from plastics and nevertheless has strong mechanical cohesion.

This object is solved in that either one the corner posts on the one hand and the floor element and the ceiling element on the other hand, or on the wall parts on the one hand and the floor part and/or ceiling part on the other hand, or else on the wall parts on the one hand and the posts on the other hand, alternately overlapping connecting elements are provided which each have bores which, when the parts are assembled, are bores which line up with one another, through which locking bolts extend which ensure the cohesion of the parts thus connected.

An embodiment of the invention is preferred in which the connecting elements are provided on corner posts and the floor part and/or the ceiling part, wherein at least two diametrically opposite corner posts on the one hand and the floor part and ceiling part on the other hand are provided with alternately overlapping connecting elements, which each have bores which, when the corner posts, floor and ceiling parts are assembled, are aligned and through which locking bolts extend which ensure the cohesion of the posts with the floor part and the ceiling part.

Advantageously, the connecting elements are manufactured in the style of tongue and groove connections and are provided with bores which extend at right-angles to the groove walls and the tongue. In the preferred embodiment each connecting element has on one post and the corresponding ceiling part, and on the floor part at the other end of the post, at least two cross bores through which the locking bolts extend, wherein these locking bolts are at a minimum distance of 50 mm apart.

Furthermore, in the preferred embodiment of the invention, the connecting elements in the form of a tongue and groove extend in an arc with an angle dimension of between 30° and 90°, in particular in an arc of approximately 60°. The bores then advantageously extend in the radial direction of the radius of curvature at an angular distance of at least 30° apart, preferably approximately 45°. The radius of curvature of the arc formed by the tongue and groove is in the range between 5 and 50 cm, preferably between 15 and 30 cm, this being relative to the arc of an imaginary centre line along a groove and/or a tongue. Clearly, the curvature of the arc formed by the tongue and groove does not necessarily have to be constant, but instead can, for example, be greater in the centre area (smaller radius of curvature) than in the area of the end sections of the tongue and groove.

Furthermore, in the preferred embodiment of the invention the tongue and groove are configured wedge-shaped in longitudinal section. This facilitates assembly and nevertheless ensures reliable cohesion, in particular when the tongue is slightly over-sized with respect to the groove, such that the bores in the tongue and groove can only be brought into alignment with one another using a certain degree of force, and are held solidly engaged in this position by means of the bolts.

Preferably, the connecting elements in the form of tongues are located on the upper and lower ends of the posts, while the connecting elements on the ceiling part and on the floor part are provided with the corresponding grooves, the walls of the grooves moreover extend into the corner areas of the floor part and the ceiling part approximately perpendicularly to the plane of the floor and respectively the ceiling part, in the direction of the posts. In the floor, the imaginary extension of the posts and respectively of the connecting elements, plastics extensions or "lugs" are also provided, which each have a lifting eye in the form of a large cross bore.

All cross bores through hollow parts, in particular through the hollow walls of the grooves and also through the hollow tongue on the upper and lower ends of the posts are configured as continuously sheathed bores and pipes respectively, which facilitates the transfer of forces via inserted locking bolts, and provides a better distribution of plastics material.

In the preferred embodiment of the invention, the cabin has four corner posts and a substantially square floor area with rounded corners. The external contour of the corner posts follows this curvature, and in cross-section the corner posts extend over a greater or lesser sized arc as far as the wall elements which are configured as an infill or panelling between the corner posts.

The wall thickness of the hollow parts, in particular of the walls of the grooves and of the tongues are between approximately 3 mm and 6 mm, and, to the extent that the transfer of forces between the posts, ceiling part and floor part is applied through the completely sheathed cross bores and the locking bolts, can transfer relatively large pulling and pushing forces. The greatest wall thickness should therefore be provided in the area of the cross bores of the connecting elements.

The provision of two connecting bolts at a distance apart from one another on each pair of connecting elements therefore contributed significantly to improving stability and to increasing cohesion.

Using the lifting eyes, the entire cabin can be suspended on two diametrically opposite posts. Advantageously all the posts are provided with the connecting elements, and the floor part and ceiling part have the corresponding connecting elements in all corner area. The lifting eyes in the imaginary extension of the posts on the ceiling part are also advantageously provided in all the corner areas. The lifting eyes are cross bores in the lugs or tabs on the upper end of the connecting elements of the ceiling part, which have a relatively large diameter of, for example, 50 mm.

The wall parts are advantageously received in grooves which run along the long side edges of the individual posts, wherein corresponding grooves can also be provided in the floor part and in the ceiling part, so that the edge of the wall parts is continuously enclosed in the posts, floor parts, and ceiling parts when the cabin is completely assembled. Clearly, the edges of the wall parts acting as a type of tongue in a lateral groove in the posts and engaging in corresponding grooves along the edges of floor and ceiling parts could also be connected to the posts and respectively the ceiling and floor part by means of appropriate bores and bolts extending through them.

One of the wall elements is naturally configured as a door so that there is access to the cabin. The wall parts can also, where necessary, be manufactured as double-walled hollow parts, if, for example, good thermal insulation is desired. In addition, the wall parts have embossed strengthening structures in the form of longitudinal and transverse ribs which can also be arranged in a decorative fashion so that with respect to the three-dimensional structure, an optical impression similar to wood panelling is provided.

Figure 2:
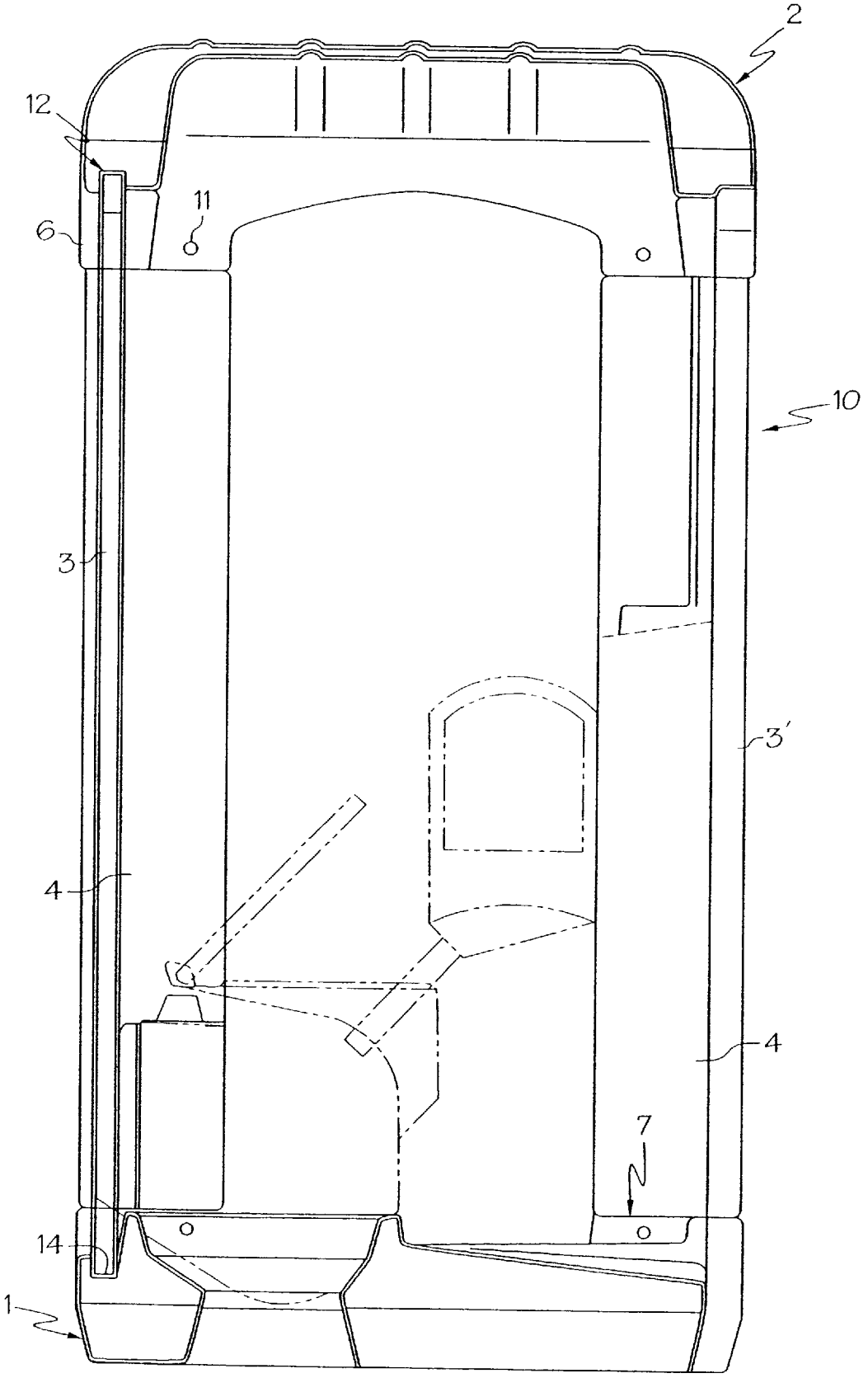
Figure 3:
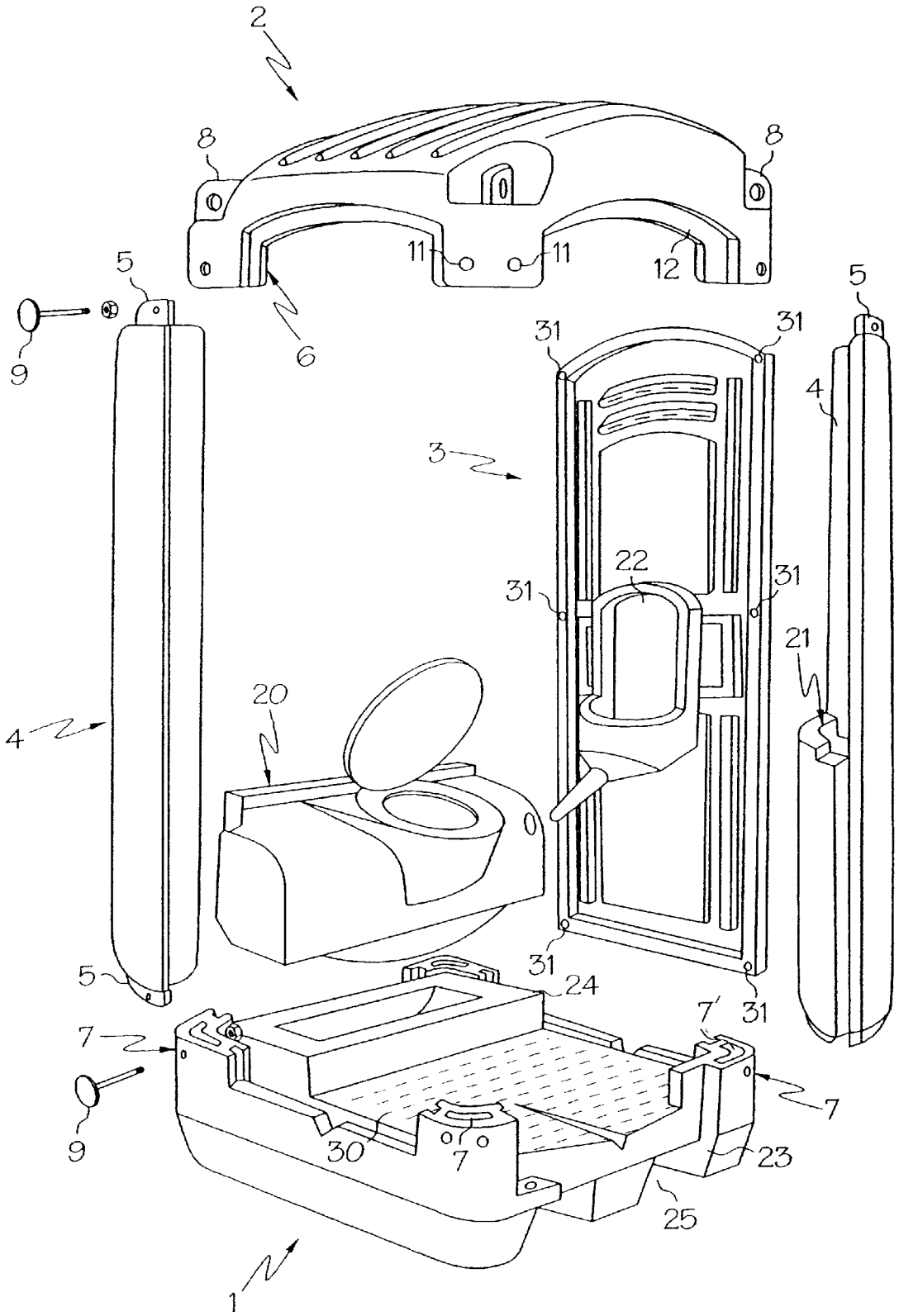
Figure 4:
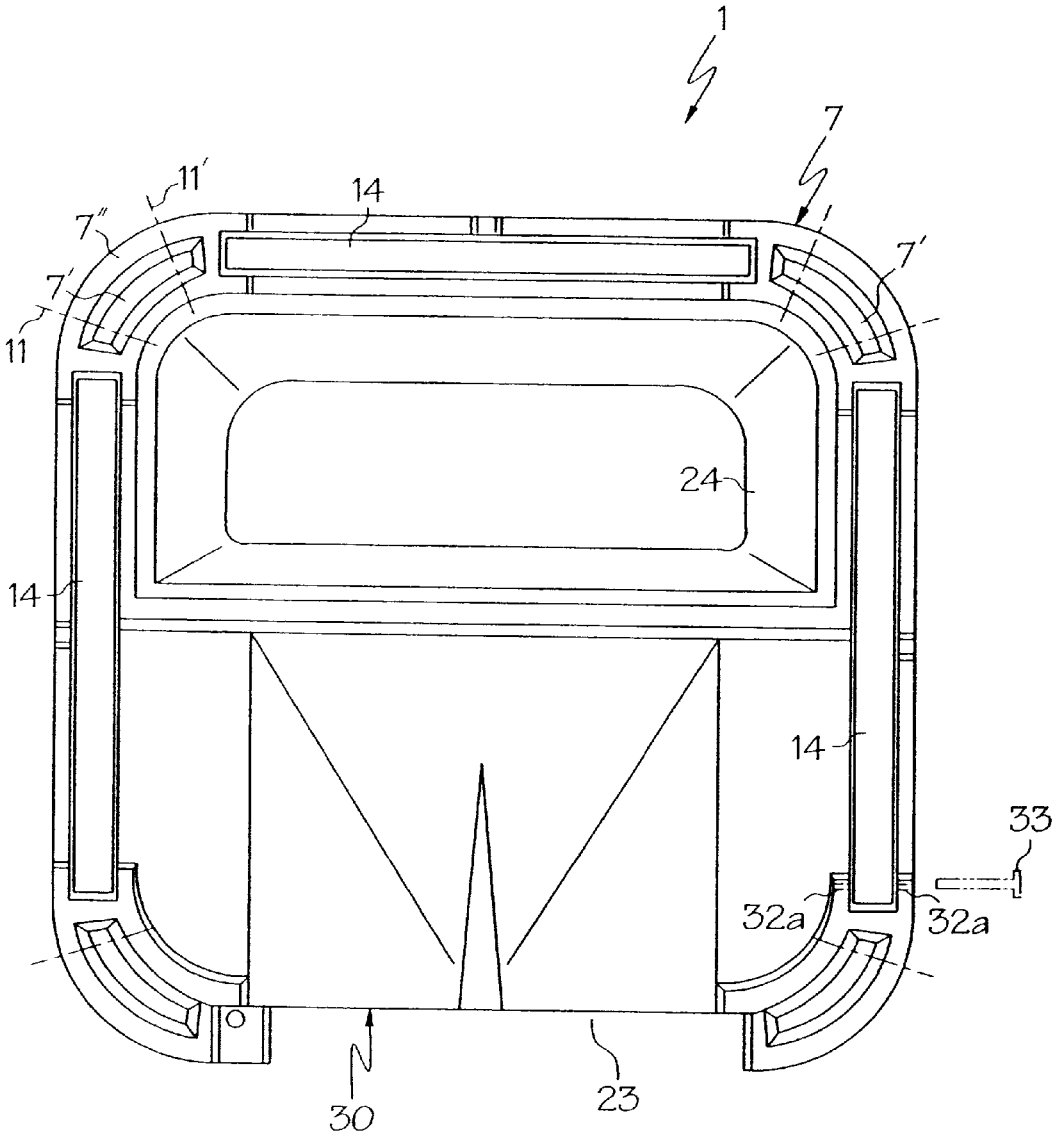

Further advantages, features, and possibilities of application of the present invention will become evident from the following description of a preferred embodiment and from the attached drawings. In these is shown, in:

FIG. 1 a frontal view of a cabin 10 with components indicated schematically, FIG. 2 a sectional view of the cabin according to FIG. 1 with a section plane along the line II—II of FIG. 1, FIG. 3 an exploded view in perspective of the individual parts of the cabin, wherein, however, only two of the four posts are shown, FIG. 4 a plan view from above of a floor element 1, FIG. 5 the side view of a post 4, FIG. 6 the lower section of a further post 4, FIG. 7 a view from above of yet a further post, to the right in FIG. 3.

Figure 8:
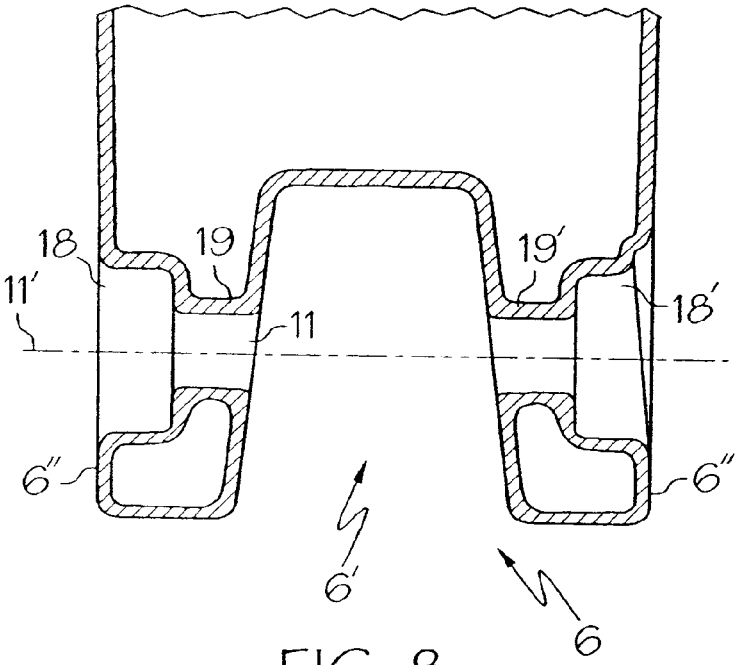
Figure 9:
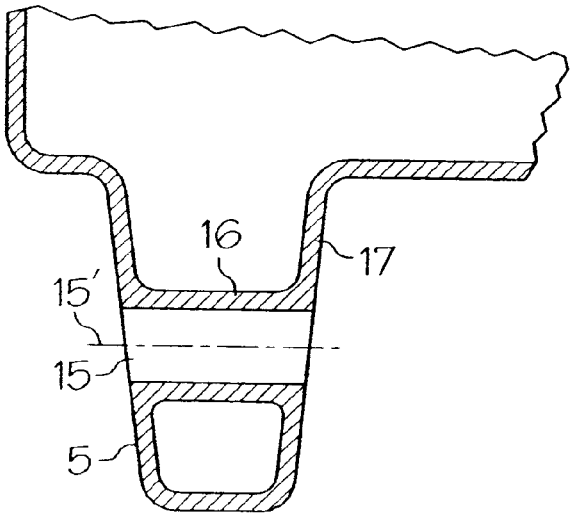

FIG. 8 a sectional view through one of the upper connecting elements 6, and FIG. 9 a sectional view through a lower connecting element 5 of a post 4.

The cabin 10 shown in a frontal view in FIG. 1, without a door, has a substantially square cross-section with rounded corners. It is substantially composed of a lower floor part 1, four posts 4 projecting at the corners, between which wall elements 3, not visible in FIG. 1, are fitted, and a ceiling element 2 sitting on the top on the posts 4. The cabin 10 is substantially held together by bolts not shown in FIG. 1, which extend through bores 11 which are configured in upwardly facing upper connecting elements 6 and in downwardly facing lower connecting elements 7, and which are orientated to line up with bores 15 which are not evident in FIG. 1 in connecting elements 5 of the posts 4. The ceiling part is configured with integral lifting eyes 8 on its upper end in the corner areas over the posts 4.

In FIG. 2 which shows a section a view according to the line II—II in FIG. 1, a rear wall element 3 is shown which is fitted into the lower floor element 1 in a groove 14 and extends upwards to the ceiling element 2 into a groove 12. The connecting element 6 which is also shown touches only one rear edge of one side edge of the wall element 3, and substantially serves to connect the ceiling element 2 to a post 4. Additionally shown is one of the wall elements 3' naturally configured as a door so that there is access to the cabin, which in the remaining figures is omitted for convenience of illustration. The components shown only schematically in FIGS. 1 and 2 are shown more precisely in exploded perspective diagram according to FIG. 3.

FIG. 3 clearly shows the floor part 1 which is provided with a floor plate 30, the underside of which is provided with wide recesses 25 for receiving the forks of a fork lifter or the like. The rear area of the floor plate is provided with a further receiving pedestal 24 for a toilet tank 20. On each of the four corner areas of the floor plate 30 connecting elements 7 are arranged, each of which is configured as an upwardly projecting short connecting part going around a corner, in the top of which a curved receiving groove 7' is provided for a corresponding curved tongue 5 on the underside of a post 4. FIG. 4 again shows a plan view of the floor plate 30 and here it is evident that the receiving groove 7' is a downwardly tapering blind bore which is surrounded by walls 7" which together form the upwardly projecting connecting insert 7.

A so-called urinal 22, which leads into the toilet tank 20 via a pipe connection, is fixed to the wall element 3 shown in FIG. 3. The post 4 shown on the right is furthermore equipped with an integrally moulded wash basin 21 or a storage means.

The ceiling part 2 is curved in one direction and has a few strengthening ribs on its upper side. With respect to the connecting elements 6, it is configured almost as a mirror image of the connecting elements 7 of the floor part. In other words, the connecting elements 6 are composed of downwardly projecting extensions which have a curved groove 6" in their lower end faces, which is surrounded by walls 6' which form the downwardly projecting extension. Two bores 11 extend through the walls 6" and also through the groove 6', which, when the cabin is assembled, line up with bores 15 which can be seen in FIGS. 5, 6 and 9. After the posts 4 have been inserted with their connecting elements 5 in the grooves 7' on the connecting elements 7 of the floor part 1, and subsequently the ceiling part has also been placed in a corresponding manner with the grooves 6' on the tongues 5 on the top of the posts 4, bolts 9 are inserted through the lined up bores 11, 15 and are screwed up from the inside with nuts which are screwed onto the thread of the bolts in order to obtain a strong cohesion of the floor, posts and ceiling part.

On the top of the connecting element 6, FIG. 3 again clearly shows the lifting eyes 8 already described, which are moulded onto integrally moulded lugs or tags directly over the connecting elements 5, as in this manner during transportation by crane the forces are transferred by means of the lifting eyes 8 directly via the connecting elements 6, 5 and the bolts 9 to the posts and from these to the floor part 1.

In the view according to FIG. 4 of the floor part from above, the curved receiving grooves 7' of the connecting element 7 and the walls 7" thereof can again be clearly seen. The location of the bores 11 is indicated by their axes 11'. Close to the outer edge and approximately in alignment with the ends of the curved grooves 7', the floor plate 30 is additionally provided with receiving grooves 14 for the lower edges of wall elements 3. The lower connecting elements 7' additionally have, in the imaginary extension of the curved grooves 7', further small groove extensions 13' which lie in the imaginary vertical extension of grooves 13 of the posts 4, which is best seen in FIGS. 5 to 7.

Clearly, the edges of the wall elements 3 acting as a type of tongue in lateral grooves 13 of the posts 4 and engaging in the corresponding grooves 14, 12 along the edges of floor and ceiling parts 1 and 2, respectively, could also be connected to the posts and /or respectively the ceiling and floor part by means of appropriate bores 31, 32*a*, 32*b*, as shown by FIGS. 3, 4 and 7, respectively, and bolts 33 (FIGS. 4 and 7) extending through them.

The four posts of the cabin 10 shown here are all somewhat different from one another. FIG. 5 shows, for example, a complete view of a post 4 which is shown on the left in FIG. 3 and forms the rear, left post according to the frontal view of FIG. 1. FIG. 6 shows the lower end, for example, of the front left post (according to the view of FIG. 1) and the view from above of a post according to FIG. 7 corresponds to the view from above of the post in FIG. 1 shown at the front right, which is also shown on the right-hand side of the exploded perspective diagram according to FIG. 3.

The post 4 according to FIG. 5 has on its bottom end a further recess 27 for engaging with the toilet tank 20 in order to hold it fast on the receiving pedestal 24. The two vertical side edges of the post 4 each have a receiving groove 13 which lines up approximately with the imaginary extension of the upper and lower tongues 5, wherein in FIG. 5, however, only one of the two grooves 13 is shown in plan view on one side edge. From the two tongues, respectively, only one of the two receiving bores 15 for a bolt 9 is evident. In FIG. 6 the bottom end of a post 4, but without the gap 26 already described, is shown further enlarged and here too the receiving groove 13 for the side edge of a wall element 3, and the lower connecting element in the form of a tongue 5 with a cross bore 15 can be seen.

FIG. 7 is the view from above of the post shown at the front right in FIG. 4, wherein a tongue 5 is being viewed from above, and wherein the location of the receiving bores is indicated by the location of their axes 15'. On the right there is further shown a small hand basin 21 which can also be replaced by a simple storage means and which is also clearly visible in the perspective view according to FIG. 3. Furthermore, at the bottom right in FIG. 7 there is shown the receiving groove 13 for a wall element and at the top right the recess 23 for receiving a door.

FIG. 8 shows a section through a connecting element 6 on a ceiling part 2, wherein the section runs vertically and along one of the axes 11' of a bore 11. As can be seen, the receiving groove 6' is trapeze-shaped in cross-section and tapers towards the top, and the receiving bore 11 has on its two opposite ends widened areas 18, 18' for receiving a bolt head and respectively a nut on the other end of a threaded bolt 9. As the walls 6" of the groove 6' are hollow walls, as can be seen clearly in the sectional view according to FIG. 8, and the walls of the bore 11 are configured as short pipe pieces 19, 19', as in this way the acting upon the connecting elements 6 and transferred through a bolt 9 can be significantly better absorbed and distributed.

The tongues 5 are also configured in a analogous manner, wherein a lower tongue 5 which can be fitted into a groove 7' on the connecting element 7 of a floor part is shown in FIG. 9. The tongues 5 which can be inserted into the upper groove 6' are simply a mirror-image of the tongues shown in FIG. 9. The tongue 5 is also a hollow, double-walled part in which the continuous bore 15 is defined by a pipe section 16. The wall thickness of the wall 17 and also the wall thickness of the wall section 6" of the connecting element 6 and the corresponding wall section 7" of the connecting element 7 can be a greater wall thickness than the other wall parts which form the posts 4, so that the forces occurring mainly on the connecting elements 5, 6, 7 can be effectively absorbed and distributed without any parts tearing away. The tongue 5, wedge shaped in cross-section, can be slightly over-sized compared to the receiving groove 6' and respectively 7' so that the tongue 5 fits tightly into the groove 6' and respectively 7' when the bores 11, 15 are made to line up with one another. The wedge-shape also facilitates the insertion of the tongues 5 into the grooves 6', 7', so no excessive force is required for this, wherein the pulling apart of the posts 4 and ceiling part 2 and respectively floor part 1 when the cabin 10 has to be dismantled presents no difficulties.

As is already evident from the general description and the claims, the connection does not necessarily have to be between the corner posts and floor part and ceiling part as shown in the drawings, but instead corresponding connecting elements can also be provided between the corner posts and the wall parts or between the wall parts and the floor and ceiling part, whereby a connection with the floor part and ceiling part either via the corner posts or via the wall parts is preferred in order to provide the cabin 10 with maximum stability and a good transportability, for example with the aid of lifting eyes on the ceiling part. Clearly, all three groups of elements, that is to say the corner posts, wall parts and floor and ceiling part can also be connected using appropriate overlapping connecting elements with cross bores, through which bolts extend. The preferred embodiment has the advantage, however, of relatively simple and inexpensive manufacture and assembly of the cabin.

What is claimed is:

1. A free-standing toilet cabin, comprising:

a floor part defining a first plurality of lateral grooves and having a first plurality of projections extending substantially perpendicularly to the plane of said floor part, said first plurality of projections each having side wall portions with first throughbores;

a ceiling part defining a second plurality of lateral grooves and a second plurality of projections extending substantially perpendicular to the plane of said ceiling part, said second plurality of projections each having side wall portions with second throughbores;

wall elements supported in corresponding ones of said first and second plurality of lateral grooves of said ceiling and floor parts; and, a plurality of elongated posts supporting said ceiling part from said floor part, wherein said posts mate with corresponding ones of said first and second projections via tongue and groove, each of said posts defining third and fourth throughbores which line up with corresponding ones of said first and second throughbores of said first and second projections, and through which locking bolts extend to ensure cohesion of said posts with said ceiling and floor parts.

2. The free-standing toilet cabin as in claim 1, wherein one of said wall elements is a door.

3. The free-standing toilet cabin as in claim 1, wherein each of said first plurality of lateral grooves extend between and into a respective pair of said first plurality of projections, and each of said second plurality of lateral grooves extend between and into a respective pair of said second plurality of projections.

4. The free-standing toilet cabin as in claim 1, wherein said floor and ceiling parts are substantially rectangular, and said first and second plurality of projections extend substantially perpendicular with respect to said floor and ceiling planes from corner areas of said floor and ceiling parts, respectively, and said plurality of elongated posts is exactly four.

5. The free-standing toilet cabin as in claim 1, wherein said ceiling part is provided with lifting eyes.

6. The free-standing toilet cabin as in claim 1, wherein said posts have side grooves provided such that side edges of said wall elements are received therein.

7. The free-standing toilet cabin as in claim 1, wherein said wall elements are provided with embossed strengthening structures.

8. The free-standing toilet cabin as in claim 1, wherein said floor part further has a receiving pedestal adapted to receive a toilet tank, and an underside provided with wide recesses adapted to receive forks of a fork lift.

9. The free-standing toilet cabin as in claim 1, wherein said throughbores are defined such that said locking bolts are a minimum distance of 50 mm apart.

10. The free-standing toilet cabin as in claim 1, wherein said floor and ceiling, said wall elements, and said plurality of posts are hollow, double wall polyethylene parts.

11. The free-standing toilet cabin as in claim 10, wherein a wall thickness of said hollow, double wall polyethylene parts are between about 3 mm to about 6 mm.

12. The free-standing toilet cabin as in claim 1, wherein said side walls of each said first and second plurality of projections define a receiving groove therebetween, and each said plurality of elongated posts having at each end a tongue portion.

13. The free-standing toilet cabin as in claim 12, wherein each said receiving groove of said first and second plurality of projections defines a tapering blind bore.

14. The free-standing toilet cabin as in claim 12, wherein each said receiving groove of said first and second plurality of projections and each said tongue portion of said plurality of posts are wedge-shaped in longitudinal section.

15. The free-standing toilet cabin as in claim 12, wherein each said receiving groove of said first and second plurality of projections and each said tongue portion of said plurality of posts extend in an arc with an angle dimension of between 30° and 90°, and preferably about 60°.

16. The free-standing toilet cabin as in claim 15, wherein a radius of curvature of said arc of each said receiving groove of said first and second plurality of projections and each said tongue portion of said plurality of posts is between 5 cm and about 50 cm, and preferably between about 15 cm and about 30 cm.

17. The free-standing toilet cabin as in claim 16, wherein said throughbores have an angular distance apart of at least 30°, preferably of approximately 45°, and extend through said side walls at right-angles.

18. A free-standing toilet cabin, comprising:

a floor part having a first plurality of projections extending substantially perpendicularly to the plane of said floor part, said first plurality of projections each having side wall portions with first throughbores and defining an upwardly facing receiving groove;

a ceiling part having a second plurality of projections extends substantially perpendicular to the plane of said ceiling part, said second plurality of projections each having side wall portions with second throughbores and defining a downwardly facing receiving groove;

a plurality of elongated posts supporting said ceiling part from said floor part, said posts each having side grooves and tongue portions provided at opposed ends of said posts which insert into corresponding ones of upwardly and downwardly facing receiving grooves, said tongue portions having third and fourth throughbores which line up with said corresponding ones of said first and second throughbores, respectively, and through which locking bolts extend to ensure cohesion of said posts with said ceiling and floor part; and, wall elements supported between said ceiling and floor parts in said side grooves of said post.

19. The free-standing toilet cabin as in claim 18, wherein said floor and ceiling parts are substantially rectangular, and said first and second plurality of projections extend substantially perpendicular with respect to said floor and ceiling planes from corner areas of said floor and ceiling parts, respectively, and each said first and second plurality of projections has an exterior curved surface.

20. A free-standing toiled cabin, comprising:

a floor part having a first plurality of projections extending substantially perpendicularly to the plane of said floor part, said first plurality of projections each having side wall portions with first throughbores and defining an upwardly facing receiving groove, said floor defining a first plurality of lateral grooves extending between and into adjacent ones of said first plurality of projections;

a ceiling part having a second plurality of projections extending substantially perpendicular to the plane of said ceiling part, said second plurality of projections each having side wall portions with second throughbores and defining a downwardly facing receiving groove, and ceiling part defining a second plurality of lateral grooves extending between and into adjacent ones of said first plurality of projections;

a plurality of elongated posts supporting said ceiling part from said floor part, said posts each having side grooves and tongue portions provided at opposed ends which insert into corresponding ones of said upwardly and downwardly facing receiving grooves, said tongue portions having third and fourth throughbores which line up with said corresponding ones of said first and second throughbores, respectively, and through which locking bolts extend to ensure cohesion of said posts with said ceiling and floor part; and, wall elements supported in corresponding ones of said first and second plurality of lateral grooves and said side grooves.

21. A substantially plastic, easily erectable free-standing toilet cabin, comprising:

a floor part having a first plurality of groove connecting elements;

a ceiling part having a second plurality of groove connecting elements;

wall elements mountable between said floor and ceiling parts; and corner posts having a plurality of tongue connecting elements, wherein said floor part, said ceiling part, and said corner posts connect together via tongue and groove, and said groove connecting elements of said floor and ceiling parts and said tongue connecting elements of said corner posts have aligning bores through which locking bolts extend.

* * * * *

UNITED STATES PATENT AND TRADEMARK OFFICE

CERTIFICATE OF CORRECTION

PATENT NO. : 6,438,902 B1
DATED : August 27, 2002
INVENTOR(S) : Harald Georg Muller It is certified that error appears in the above-identified patent and that said Letters Patent is hereby corrected as shown below:

Column 7,
Line 42, reads as "between 30° and 90°, and preferably" should read -- between about 30° and about 90°, and preferably --;
Line 47, reads as "between 5 cm" should read -- between about 5 cm --;
Line 50, reads as "claim 16" should read -- Claim 15 --;
Line 61, reads as "extends substantially" should read -- extending substantially --;

Column 8,
Line 18, reads as "free-standing toiled cabin," should read -- free-standing toilet cabin, --;
Line 33, reads as "groove, and ceiling" should read -- groove, said ceiling --.

Signed and Sealed this

Eighteenth Day of February, 2003

JAMES E. ROGAN
*Director of the United States Patent and Trademark Office*